US005121521A

United States Patent [19]

Hagiwara et al.

[11] Patent Number: 5,121,521

[45] Date of Patent: Jun. 16, 1992

[54] MECHANISM FOR OPENING AND CLOSING AN OPENABLE APPARATUS

[75] Inventors: Kazuyoshi Hagiwara, Uenohara; Katsumi Yawata, Tokyo; Tatsumi Shimanari, Higashiyamato, all of Japan

[73] Assignees: Casio Computer Co., Ltd.; Casio Electronics Manufacturing Co., Ltd., both of Tokyo, Japan

[21] Appl. No.: 674,222

[22] Filed: Mar. 25, 1991

[30] Foreign Application Priority Data

Apr. 3, 1990 [JP] Japan ..... 2-35962[U]
Apr. 3, 1990 [JP] Japan ..... 2-35963[U]

[51] Int. Cl.[5] ..... E05F 1/08; E05D 7/00

[52] U.S. Cl. ..... 16/278; 16/354; 16/357; 16/374

[58] Field of Search ..... 16/278, 277, 354, 357, 16/374, 62, 280, 297, 319

[56] References Cited

U.S. PATENT DOCUMENTS 2,219,358 10/1940 Economides ..... 16/354
2,322,933 6/1943 Harmon et al. ..... 16/278
3,123,196 3/1964 Paone et al. ..... 16/357
4,817,240 4/1989 Sovis, Jr. et al. ..... 16/297

FOREIGN PATENT DOCUMENTS 0227399 5/1963 Austria ..... 16/319
3145317 5/1983 Fed. Rep. of Germany ..... 16/277
1-203579 8/1989 Japan ..... 16/62

*Primary Examiner*—Lowell A. Larson
*Assistant Examiner*—Michael J. McKeon
*Attorney, Agent, or Firm*—Nixon & Vanderhye

[57] ABSTRACT

A mechanism for opening and closing an openable apparatus has a body consisting of a first body portion and a second body portion. The first body portion is rotated about a pivotal axis between the closed position and the fully opened position. An arcuated gear portion having a center falling on the pivotal axis is provided. A one-way damper mechanism is connected to the gear portion directly or via a transmission gear and comprises a rotary gear rotated in cooperation with the opening and closing movements of the first body portion and a rotational speed control device for controlling the rotational speed of the first body portion when the first body portion is closed. In cooperation with the movement of the first body portion between the closed position and the fully opened position, the rotary member is rotatable about the pivotal axis between a first position at which the first body portion is closed and a second position at which the first body portion is fully opened. The gear portion is formed on the rotary member, and the one-way damper mechanism is provided in the first body portion, or the gear portion is formed in the first body portion and the one-way damper mechanism is provided on the gear portion.

11 Claims, 11 Drawing Sheets

MECHANISM FOR OPENING AND CLOSING AN OPENABLE APPARATUS

BACKGROUND OF THE INVENTION

1. Field of the Invention

This invention relates to a mechanism for opening and closing an openable apparatus and more particularly to a mechanism for opening and closing an openable apparatus, such as a copying machine, a printer, a facsimile machine and the like, which has a lower body portion and an upper body portion pivotally supported at a pivotal shaft at one of its ends by the lower body portion and opened and closed by the pivotal movement about the pivotal shaft.

2. Description of the Related Art

Generally, a shell type openable apparatus such as a copying machine, a printer and a facsimile machine is designed to have an upper body portion and a lower body portion and to enable the upper body portion to rotate about an pivotal axis at one of its ends so as to be opened and closed with respect to the lower body portion. When the openable apparatus is operated, maintained or checked, the upper body portion is opened.

In FIG. 5 is shown a printer used as an image formation device having an opening and closing function as an example of the conventional apparatus, the upper body portion of which is adapted to be opened and closed. The printer 1 comprises a lower body portion 2 and an upper body portion 3 provided separately from the lower body portion 2. The upper body portion 3 is opened by being rotated upward about a pivotal shaft 4 provided at one end of the upper body portion 3 to the position as shown by a two-dot chain line. This opening function facilitates the maintenance of the inner structure of the image formation device, the removal of a jammed paper sheet or the like.

Many functional components are housed in the lower body portion 2 of the printer 1, and an image formation head 5 is provided in the upper body portion 3 in such a manner that the head 5 faces an image formation drum 6 provided in the lower body portion 2 when the upper body portion 2 is closed, as shown by a solid line in FIG. 5.

In the conventional printer 1, however, the opening angle of the upper body portion 3 is generally set to less than 90°, with the result that the center of gravity of the opened upper body portion 3 is positioned so that the upper body portion 3 is biased in the closed direction, entailing a danger due to the closing of the upper body portion 3.

In this prior art, therefore, it is not easy to maintain the components (such as a unit having the image formation drum 6 as the main element) densely arranged in the lower body portion 2, due to the fact that a wide opening angle of the upper body portion 3 is not available.

When a one-way type rotary oil damper is used in this prior art, the upper body portion 3 is opened smoothly and is closed slowly. This feature exhibits a good operativeness of the upper body portion 3.

Since, however, the pivotal shaft 4 which is a center of rotation of the upper body portion 3 is provided at one end of the printer body 1, the use of the oil damper cannot make the opening angle of the upper body portion 3 equal to or more than 90°. This makes it difficult to perform maintenance of the printer such as the removal of a jammed paper sheet and the supply of a toner (a developer).

In order to widen the opening angle of the upper body portion 3 by using a one-way type rotary oil damper, a printer having a structure as shown in FIG. 6 can be used.

A printer 7 having the similar structure to that of the printer as shown in FIG. 5 comprises a lower body portion 8, an upper body portion 10 provided rotatably about a pivotal shaft 9 so as to be opened and closed, and a one-way type rotary oil damper 12 provided in the upper body portion 10 and engaging with a segmental gear 11 provided in the lower body portion 8.

In order to widen the opening angle to more than 90°, however, the upper body portion 10 must be provided with an extension 13 on which the rotary oil damper 12 is mounted, resulting in a complicated structure of the upper body portion 10. This structure has the disadvantage that it requires a high assembling cost.

Further, the one-way type rotary oil damper 12 resists against the force of the upper body portion 10 when the portion 10 is closed, that is, when it is rotated in the counterclockwise direction in FIG. 6, but the damper 12 little resists against the force of the upper body portion 10 when the portion 10 is opened, that is, when it is rotated in the clockwise direction in FIG. 6. When the upper body portion 10 passes the dead point right over the pivotal point 9 and then arrives at the fully opened position in the course of the opening of the portion 10, the weight of the upper body portion 10 acts in the direction in which the portion 10 is further opened. Since the oil damper 12 little resists against the opening force of the upper body portion 10, as explained above, the shock is directly applied to a stop for limiting the portion 10 to the opening position without being suppressed when the portion 10 is raised forcibly from the closed position, and the stop and/or a vicinity portion close thereto is liable to be broken.

On the other hand, in order to close the upper body portion 10, there are difficulties that the heavy portion 10 must be raised from the opened position to the dead point and the resistance of the rotary oil damper 12 against the rotation of the portion 10 prevents the portion 10 from moving downward smoothly.

Accordingly, where the one-way type rotary oil damper is used for opening and closing the conventional shell type openable apparatus, the above-mentioned problems arises when the apparatus is opened and closed.

SUMMARY OF THE INVENTION

The object of this invention is to provide a mechanism for opening and closing an openable apparatus, which has a simple structure, a high opening and closing operation and can be manufactures at a low cost.

In order to attain the object, a mechanism for opening and closing an apparatus according to this invention comprises:

a main body having a first body portion, a second body portion and a pivotal axis about which the first body portion is rotated with respect to the second body portion between a closed position of which the first body portion closes the second body portion and a fully opened position at which the first body portion is most opened from the second body portion;

a gear portion formed in the arcuated shape having a center thereof on the pivotal axis;

a one-way damper mechanism connected directly or via a transmission gear to the gear portion, and having a rotary gear rotating in cooperation with opening and closing movement of the first body portion and a speed controlling device for controlling a rotational speed of the first body portion when the first body portion is being closed; and a rotary member which assumes a first position when the first body portion takes a predetermined position other than the fully opened position and the closed position and a second position in which the first body portion takes the fully opened position, and is rotatable about the pivotal axis between the first and second positions in cooperation with the opening and closing movement of the first body portion between said predetermined position and fully opened position; wherein the gear portion is provided on the rotary member and the one-way damper mechanism is provided in the first body portion, or the gear portion is provided in the first body portion and the one-way damper is provided on the rotary member.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1A:
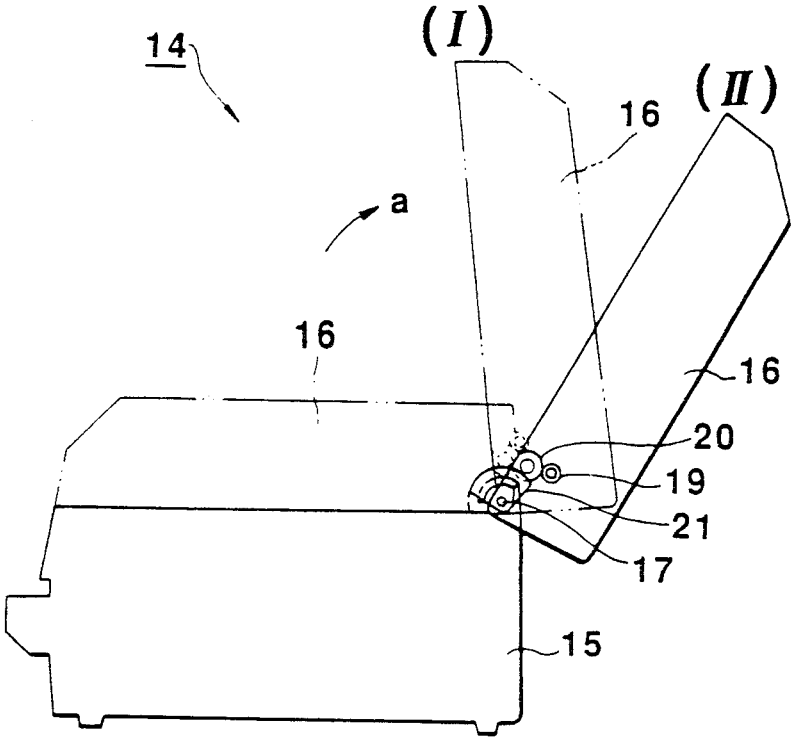
FIG. 1A is a general side elevational view of an openable apparatus using a first embodiment of the opening and closing mechanism according to this invention, in which an upper body portion is opened from a first angle to a second angle which is the maximum opening angle of the upper body portion.
Figure 1B:
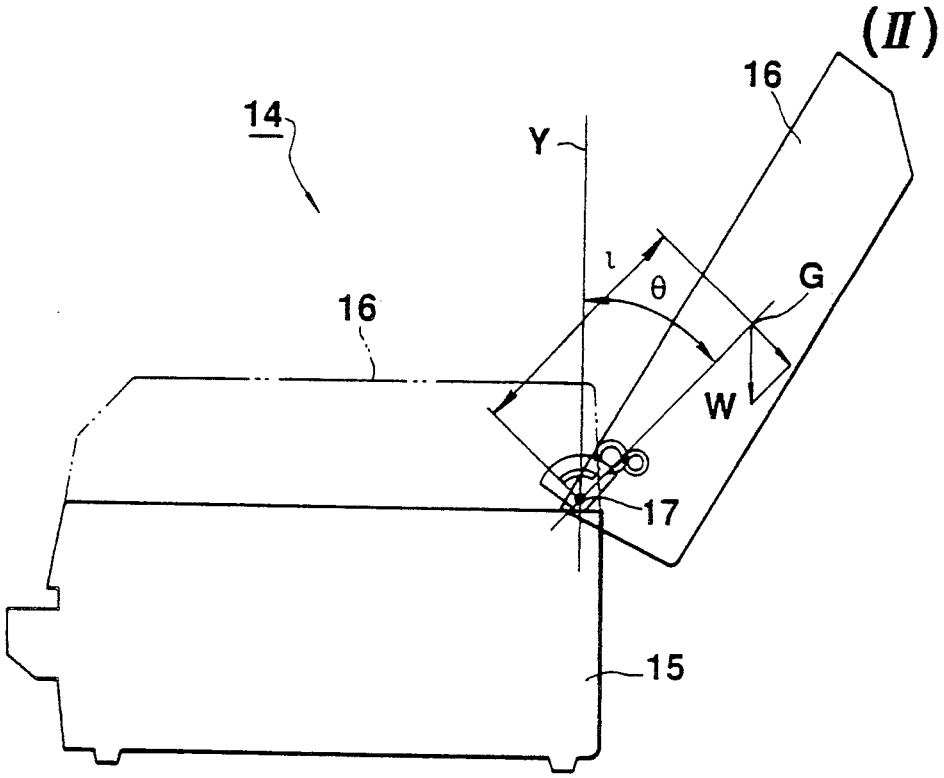
FIG. 1B is a view illustrating how the weight of the upper body portion is applied to the center of gravity of the upper body portion.
Figure 2A:
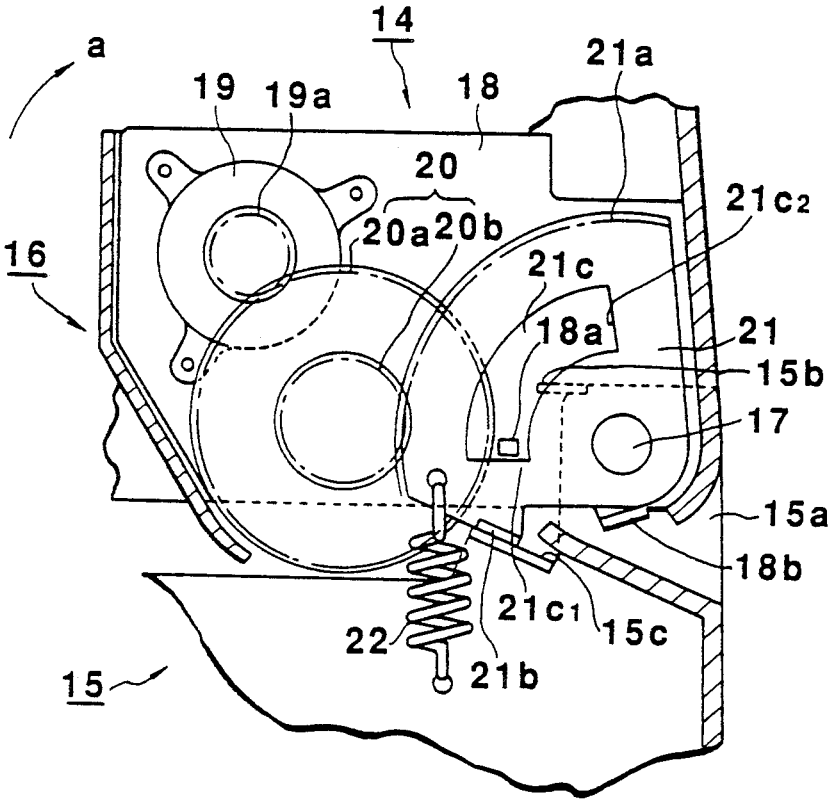
FIG. 2A is a view showing the structure of the opening and closing mechanism of the first embodiment when the upper body portion is closed.
Figure 2B:
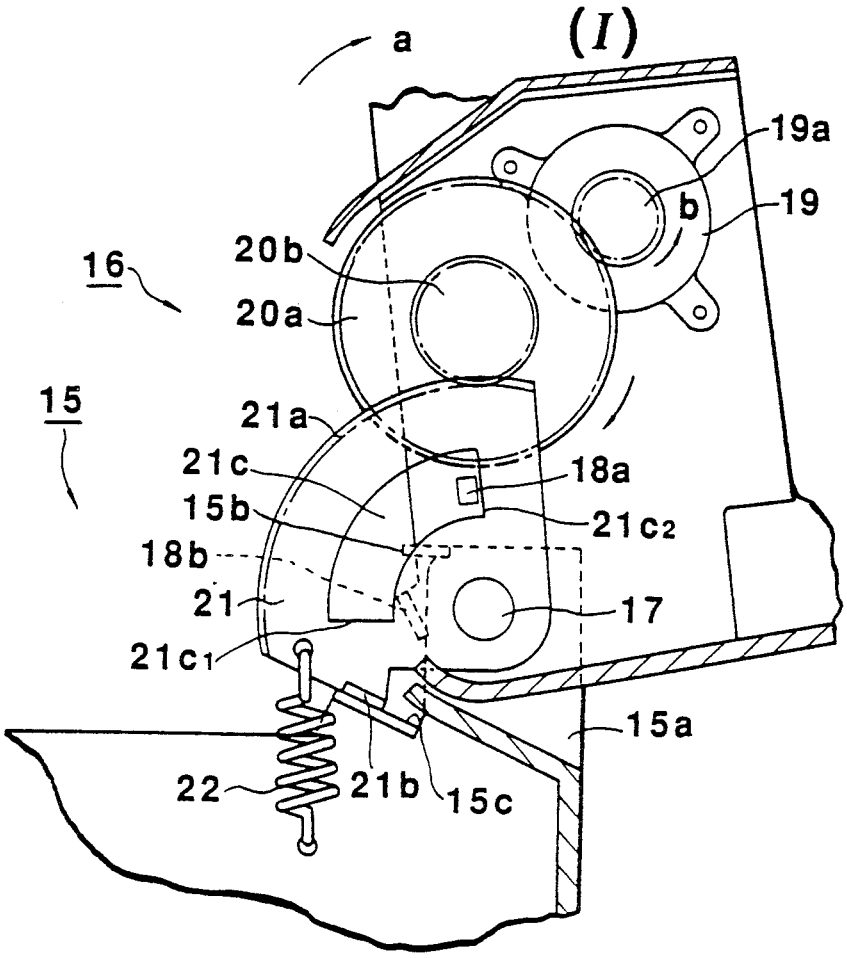
FIG. 2B is a view showing the state in which the upper body portion of the opening and closing apparatus shown in FIG. 2A is opened at the first angle.
Figure 2C:
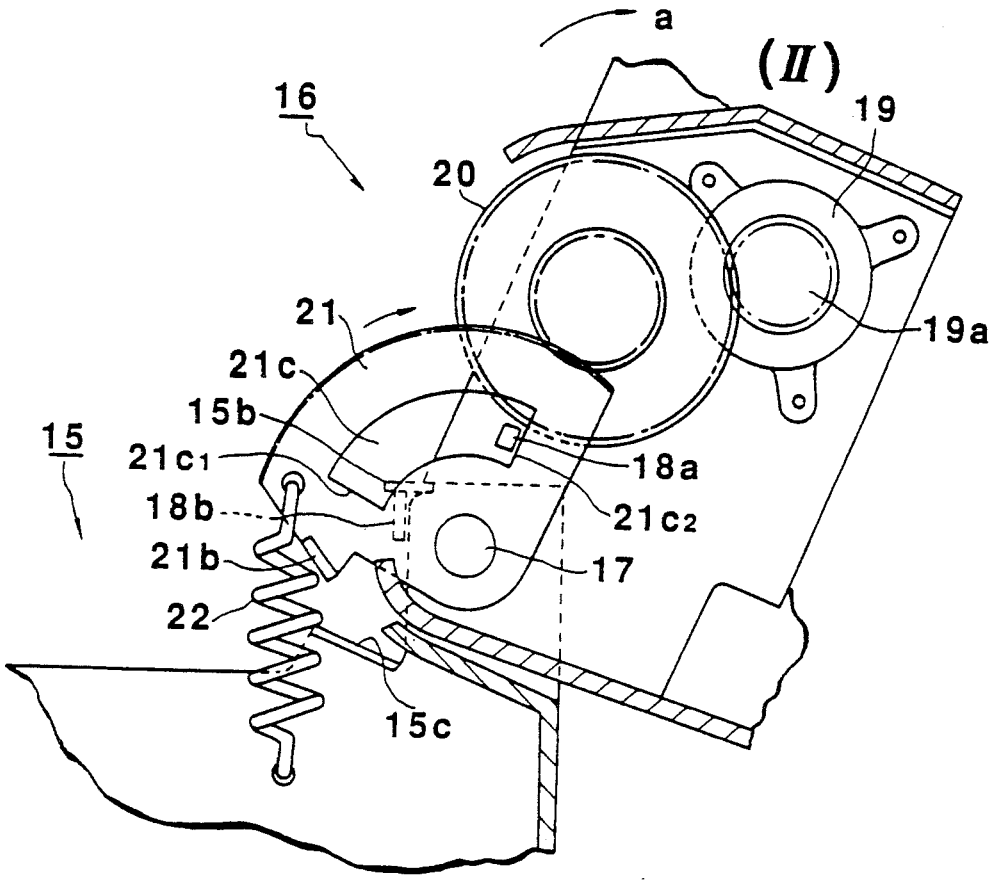
FIG. 2C is a view showing the state in which the upper body portion using the opening and closing apparatus shown in FIG. 2A is opened at the second angle.

FIG. 1A is a general side elevational view of an openable apparatus using a first embodiment of the opening and closing mechanism according to this invention, in which an upper body portion is opened from a first angle to a second angle which is the maximum opening angle of the upper body portion. FIG. 1B is a view illustrating how the weight of the upper body portion is applied to the center of gravity of the upper body portion. FIG. 2A is a view showing the structure of the opening and closing mechanism of the first embodiment when the upper body portion is closed. FIG. 2B is a view showing the state in which the upper body portion of the opening and closing apparatus shown in FIG. 2A is opened at the first angle. FIG. 2C is a view showing the state in which the upper body portion using the opening and closing apparatus shown in FIG. 2A is opened at the second angle.

In FIGS. 1A and 1B, a main body 14 of an openable apparatus such as a printer is divided into a lower body portion (second body portion) 15 and an upper body portion (first body portion) 16. One end of the lower portion of the upper body portion 16 is pivotally supported on the frame 15*a* of the lower body portion 15 by means of a pivotal shaft 17 so as to be opened and closed. The upper body portion 16 is adapted to be opened to take a first angular position (I) and a second angular position (II). The first angular position (I) is defined as the position of the upper body portion 16 at which the center of gravity G of the upper body portion 16 falls on a vertical plane Y passing the pivotal axis of the pivotal shaft 17. The second position (II) shows the position of the upper body portion 16 at which the portion 16 is opened at 90° or more from the lower body portion 15.

As shown in FIG. 1B, the upper body portion 16 is pivotally supported on the lower body portion 15 by means of the pivotal shaft 17 so that it assumes the second position (II) in which its center of gravity G is inclined by $\theta$ from the vertical plane Y Assuming that the distance between the pivotal axis of the pivotal shaft 17 and the center of gravity G is assumed to be l and the weight of the upper body portion 16 is w, the moment of force of the upper body portion 16 at the center of gravity G about the pivotal shaft 17 is $l \cdot w \cdot \sin\theta$.

As shown in FIG. 2A, a damper mounting frame 18 is fixedly provided in the upper body portion 16 with one of the lower corners penetrated by the pivotal shaft 17. The frame 18 is provided with a one-way type rotary oil damper (one-way damper mechanism, hereinafter referred to as the "one-way damper portion") 19 and a transmission gear 20 engaging with the rotary gear 19*a* of the one-way damp portion 19. The transmission gear 20 comprises a large gear 20*a* engaging with the rotary gear 19*a* of the one-way damper portion 19, and a small gear 20*b*.

On the portions of the frame 18 which are close to the pivotal shaft 17 are formed a first projection 18*a* and a second projection 18*b* which extend laterally (upward from the paper) from the frame 18. As the upper body portion 16 is opened, the first projection 18*a* abuts against a later-described rotary member 21, and the second projection 18*b* abuts against a stop 15*b* provided on the lower body portion 15.

The rotary member 21 is rotatable about the pivotal shaft 17 and is unitarily formed with an arcuated gear 21*a* having its center coaxial with the pivotal shaft 17 and engaging the small gear 20*b*. The rotary member 21 is rotatably urged by means of a spring 22 in the counterclockwise direction in FIG. 2A. The spring 22 is a coil spring which is anchored at its respective ends to the rotary member 21 and the frame 15*a* of the lower body portion 15. However, a torsion spring may be used as the spring 22 between the pivotal shaft 17 and the rotary member 21 so as to urge the rotary member 21 in the counterclockwise direction.

A stop 21*b* is formed on an end of the rotary member 21 and is received by a stop 15*c* formed on the frame 15*b* of the lower body portion 15 and disposed opposed thereto so that the stop 21*b* holds the rotary member in position.

In the range of the first projection 18*a* of the rotary member 21 is formed an arcuated slit 21*c* having its center coinciding with the pivotal axis of the pivotal shaft 17 and having an end $21c_1$ and the other end $21c_2$ in such a manner that the first projection 18*a* is inserted in the arcuated slit 21*c*.

The operation of this embodiment will now be explained with reference to FIGS. 2A to 2C.

The opening and closing mechanism as described above assumes the state as shown in FIG. 2A when it is closed. As the upper body portion 16 is manually rotated in the direction a or opened until it takes the first position (I), the transmission gear 20 is rotated and moved with respect to the rotary member 21 pulled in the counterclockwise direction by means of the spring 22 while the transmission gear 20 is in engagement with the arcuated gear portion 21*a* formed coaxially with the pivotal shaft 17, and the rotary gear 19*a* of the one-way damper portion 19 is rotated in the direction b by means of the rotating transmission gear 20, as shown in FIG. 2B.

In the step in which the rotary gear 19*a* is rotated in the direction b, the one-way damper 19 does not take a damping action. Thus, the upper body portion 16 is smoothly opened until it reaches the first angular position (I). Since the rotary member 21 is not operated in this step, the upper body portion 16 is completely freely moved from the closed position· to the first angular position (I).

When the upper body portion 16 reaches the first angular position (I), both the first projection 18*a* and the second projection 18*b* provided in the upper body portion 16 are simultaneously moved and the first projection 18*a* is rotated in the slit 21*c* of the rotary member 21 to abut against the other end $21c_2$.

Further rotation of the upper body portion 16 from the first angular position (I) to the second angular position (II) causes the rotary member 21 to be simultaneously rotated in the same direction against the biasing force of the spring 21, with the first projection 18*a* abutted against the other end of the $21c_2$.

The rotary member 21 is rotated with the transmission gear 20 and the rotary gear 19*a* set in a stationary state, and finally the second projection 18*b* of the upper body portion 16 abuts against the stop 15*b* of the lower body portion 15, whereby the upper body portion 16 stops opening at the second angular position (II), as shown in FIG. 2C. In this stage, the spring 22 is most stretched, and the upper body portion 16 is opened at the maximum opening angle (substantially 110° in this embodiment).

The availability of opening the upper body portion 15 to the second angular position (II) provides for easy replacement and good maintenance of process units and the like in the lower body portion 15.

Further, the second angular position (II) can selected by adjusting the abutting position between the second projection 18*b* and the stop 15*b*.

When the upper body portion 16 is opened to take the second angular position (II), the center of gravity G of the upper body portion 16 is moved outward from the pivotal shaft 17 (in the right hand direction in the FIG.). The angle ° and the moment of the force become the maximum. However, since the spring 22 is stretched, the shock given by the abutment between the stop 15*b* and the second projection 18*b* is reduced.

The explanation will now be made to the closing of the upper body portion 16.

The upper body portion 16 is manually moved in the reverse direction from the second angular position (II) to the position beyond the first angular position (I). When the center of gravity G of the upper body portion 16 lies on the plane Y (FIG. 1B) and arrives at the dead point, the stop 21*b* abuts against the stop 15*c*. As the center of gravity G is slightly inclined toward the closed direction (I), the upper body portion 17 assumes the position as shown in FIG. 2B in which the rotary member 21 returns to the original position by means of the biasing force of the string 22, and the first projection 18*a* passes the slit 21*c* in the reverse direction. As the upper body portion 16 is rotated by its own weight in the closing direction, the transmission gear 20 engaging the gear portion 21*a* of the rotary member 21 is rotated.

The rotary gear 19*a* of the one-way damper portion 19 is revolved in the clockwise direction in the FIG. via the transmission gear 20 so that the upper body portion 16 is automatically closed by its own weight. The one-way damper portion 19 is actuated as a rotary oil damper only when the upper body portion 16 is moved in the closing direction. As a result, the upper body portion 16 is closed with the closing force attenuated by the one-way damper portion.

In order to close the upper body portion 16 quickly, the operator may push it in the closing direction. In this case, the closing force is also attenuated by the one-way damp portion 19. After closing the lower body portion 15, the upper body portion 16 is locked by means of a locking device (not shown) so as to retain the locking state. When the locking device is released, the opening end of the upper body portion 16 is slightly raised by a spring member (not shown).

In the above embodiment, the rotation of the gear portion 21*a* of the rotary member 21 is transmitted to the rotary gear 19*a* of the one-way damper portion 19 via the transmission gear 20 in order to adjust the rotational angle of the one-way damper 19. Alternatively, the transmission gear 20 may be omitted and the rotary gear 19*a* of the one-way damper portion 19 may be directly engaged with the gear portion of the rotary member 21.

A second embodiment of this invention which does not employ the transmission gear will now be explained with reference to FIGS. 3A to 3C.

Figure 3A:
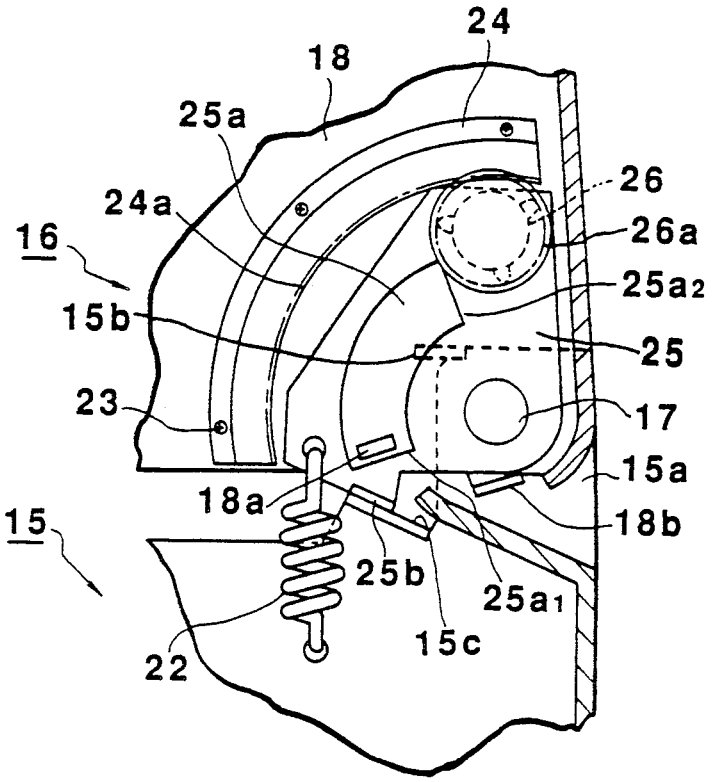
FIG. 3A is a view showing the structure of a second embodiment of the opening and closing mechanism according to this invention when the upper body portion is closed.

FIG. 3A is a view showing the structure of a second embodiment of the opening and closing mechanism according to this invention when the upper body portion is closed. FIG. 3B is a view showing the state in which the upper body portion using the opening and closing mechanism shown in FIG. 3A is opened at a first angle. FIG. 3C is a view showing the state in which the upper body portion shown in FIG. 3A is opened at a second angle which is the maximum opened angle of the upper body portion.

In the second embodiment, the same parts and members as those of the first embodiment are designated by the same referential numerals, the detailed explanation thereof being omitted.

Figure 3B:
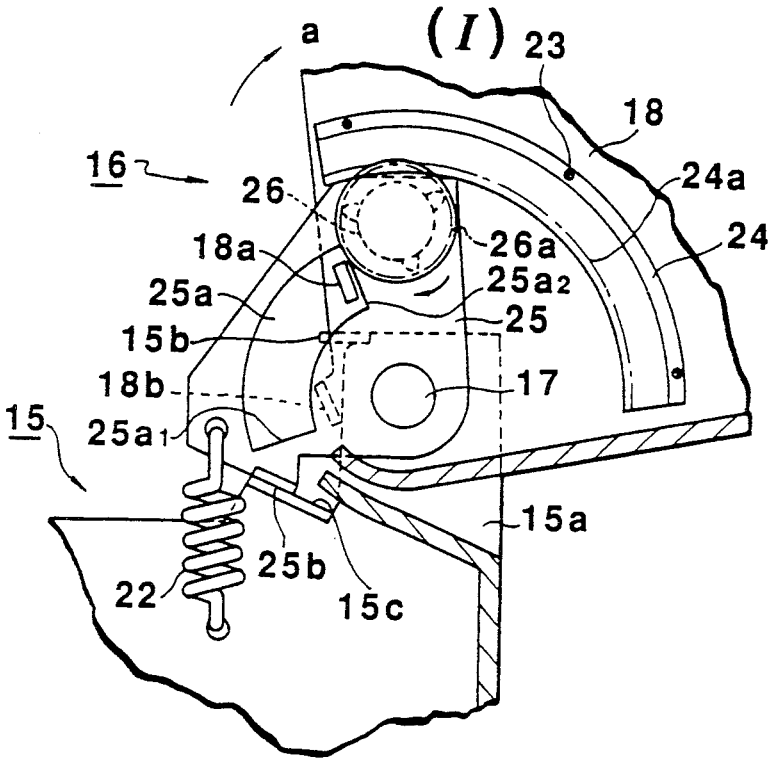
FIG. 3B is a view showing the state in which the upper body portion using the opening and closing mechanism shown in FIG. 3A is opened at a first angle.
Figure 3C:
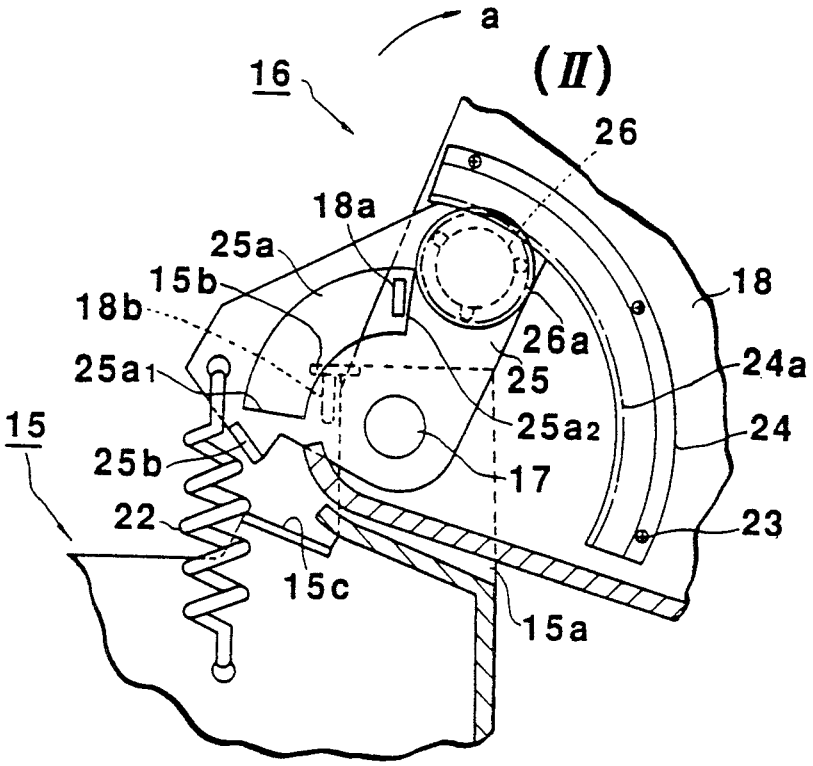
FIG. 3C is a view showing the state in which the upper body portion shown in FIG. 3A is opened at a second angle which is the maximum opened angle of the upper body portion.

In FIGS. 3A to 3C, a gear member 24 formed with an arcuated internal gear 24a having its center lying on the pivotal axis of a pivotal shaft 17 is fixed by means of screws 23 or the like to a frame 18 provided in an upper body portion 16. A rotary member 25 is provided within the inner space of the gear member 24 so as to rotate about the pivotal shaft 17. An arcuated slit 25a having one end $25a_1$ and the other end $25a_2$ is formed coaxial with the pivotal shaft 17 in the rotary member 25, and receives a first projection 18a formed on the frame 18.

The rotary member 25 is urged by the biasing force of a spring 22 in the counterclockwise direction in the FIGS. to cause a stop 25b to abut against a stop 15c disposed opposed thereto so that the rotary member 25 prevented from being further rotated in the urged direction.

Fixed to the rotary member 25 is a one-way damper portion (a one-way type rotary oil damper) 26 having a rotary gear 26a engaging with the internal gear portion 24a. The rotary gear 26a and the internal gear portion 24a are arranged such that, when the upper body portion 16 is closed, the rotary gear 26a is disposed at the upper right end portion of the internal gear portion 24a, as shown in FIG. 3A.

As the upper body portion 16 is rotated in the opening direction (in the direction of arrow a) as shown in FIG. 3B, the internal gear portion 24a is rotated in the direction of arrow a about the pivotal shaft 17 with the one-way damper portion 26 remained at the original position by means of the biasing force of a spring 22. The first projection 18a moves in the slit 25a toward the other end $25a_2$ of the slit 25a and abuts against the other end $25a_2$ when the upper body portion 16 is opened to a first angular position (I). In this state, the rotary gear 26a of the open-way damper 26 stops rotating with respect to the internal gear 24a.

In the course of the rotation of the upper body portion 16 from the angular position (I) (FIG. 3B) to an angular position (II) (FIG. 3C), the first projection 18a rotates the rotary member 25 in the same direction against the biasing force of the spring 22. The rotary gear 26a is moved in an irrotational state together with the internal gear 24a so that the center of gravity of the upper body portion 17 is transferred to the right side of the pivotal shaft 17. Finally, a second projection 18b abuts against a stop 15b to hold the upper body portion 16 at the second angular position (II) at which the portion 16 is fully opened.

The closing operation of the upper body portion 16 will now be explained.

The process is reversed from the one of the opening process. The upper body portion 16 is manually raised and is returned from the state shown in FIG. 3C to that shown in FIG. 3B. In the state of FIG. 3B, the upper body portion 17 starts to be closed by its own weight, and immediately after passing the first angular position (I), the first projection 18a is disengaged from the rotary member 25 and the stop 15c abuts against the stop 25b, as shown in FIG. 3B. When this occurs, the rotating internal gear 24a turns the rotary gear 26a of the one-way damper portion 26 in the counterclockwise direction at its original position shown in FIG. 3B, whereby the one-way damper portion 26 is actuated to do a damping action. In this connection, the upper body portion 16 is automatically closed in a damped manner.

In the first and second embodiments, the engagement between the first projections 18a and the corresponding rotary members 21 and 25 are effected through the slits 21a and 25a, respectively. However, the slots 21a and 25b can be omitted to attain this engagement.

Any shape of the rotary members 21 and 26 is available, provided that, upon opening and closing the upper body portion, they reduce the shock applied to the stops for restricting the opening and closing movement of the upper body portion when the one-way damper portion is not in an active state, and do not hinder the attenuating action of the damper portion when the damper portion is active.

Figure 4:
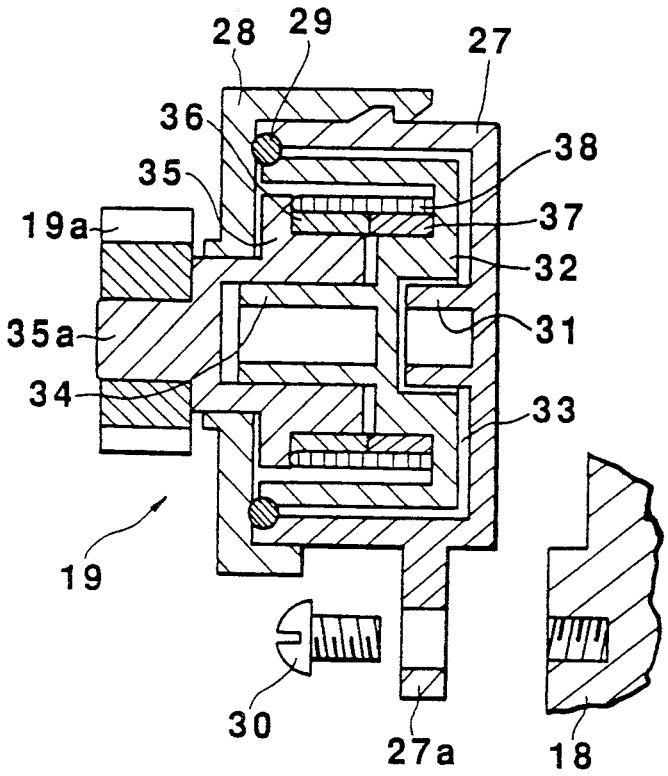
FIG. 4 is a longitudinal cross-sectional view of an embodiment of a one-way type rotary oil damper used in the embodiments of this invention.
Figure 5:
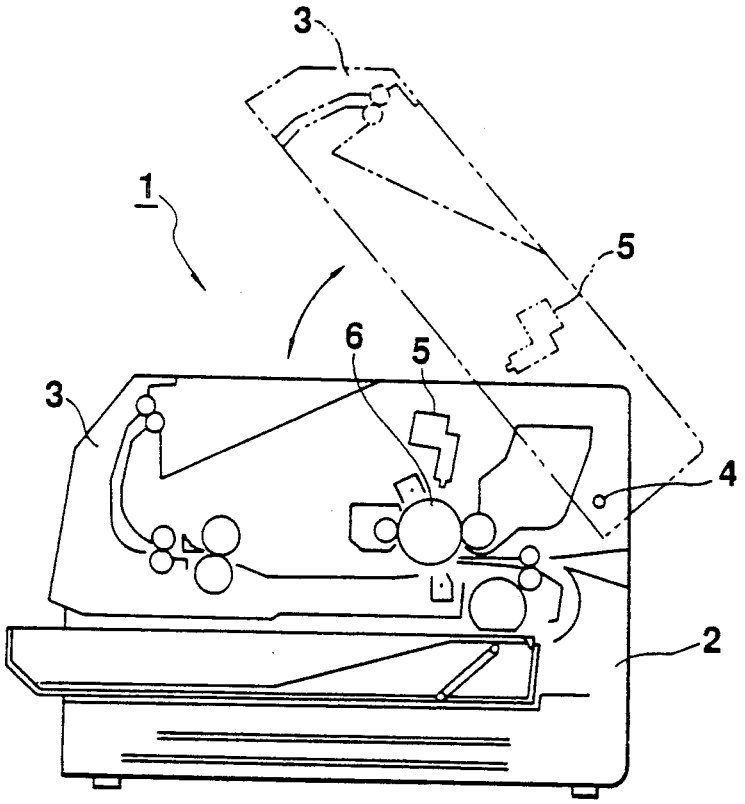
FIG. 5 (PRIOR ART)
FIG. 5 is a general side elevational view of a conventional printer having an opening and closing function.
Figure 6:
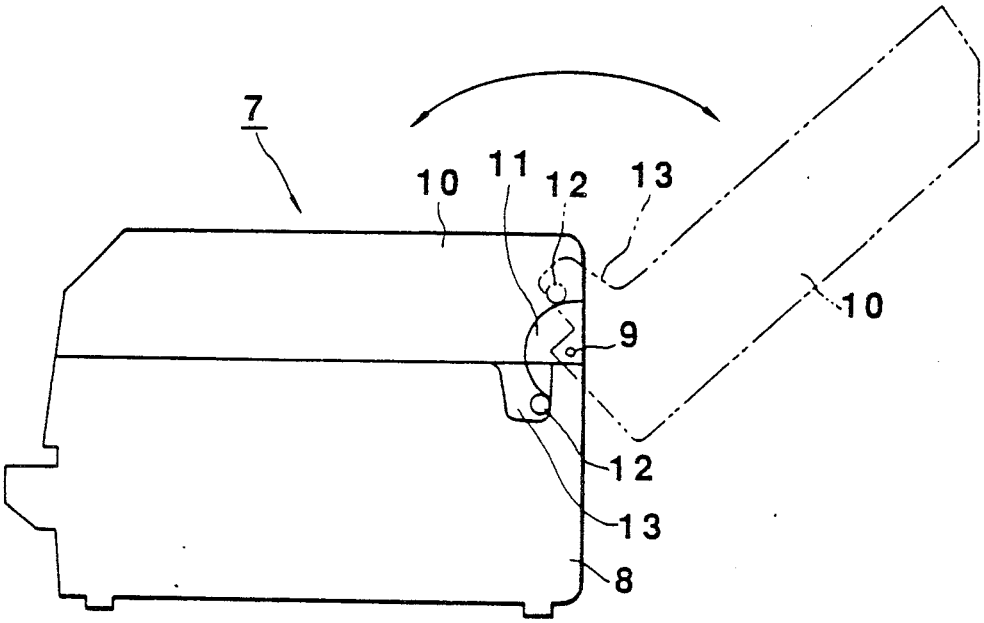
FIG. 6 is a general side elevational view of a further conventional printer having an opening and closing function.

In FIG. 4 is shown a longitudinal cross-sectional view of one embodiment of the one-way damper portion used in the first embodiment and designated by referential numeral 19.

The one-way damper portion 19 has a cylindrical casing 27 and a cover 28 fitted on the cylindrical casing 25 via O-ring 29. From the outer peripheral wall of the cylindrical casing 25 project three mounting portions 27a which are fixed to the damper mounting frame 18 as e supporting member of the one-way damper portion 26.

Within the casing 27 is formed a central boss 31 acting as a fixed shaft and rotatably supporting a rotary member 32. Siliconegrease is filled in the space defined between the rotary member 32 and the casing 27. From central portion of the rotary member 32 extends a boss-like shaft 34 on which a rotating member 35 is mounted. The rotating member 35 has a rotating shaft 35a on which the rotary gear 19a is pressingly fitted. The rotating member 35 and the rotary member 32 have flush outer peripheral surface portions on which collars 36 and 37 are mounted in tandem so that they are immovably connected to the rotating member 35 and the rotary member 32, respectively, by means of keys (not shown). The outer peripheral surfaces of the collars 36 and 37 are made flush with each other, and have mounted thereon a one-way spring 38 which connects the rotating member 35 to and disconnects the same from the rotary member 32 according to the rotating directions of the rotating member 35 such that the transmission and non-transmission of the rotating force from the rotating member 35 to the rotary member 32 are carried out according to the directions of the rotation of the rotating member 35.

At the time of disconnection between the rotating member 35 and the rotary member 32, the rotating member 35 is freely rotated with respect to the rotary member 32. At the time of connection therebetween, however, both the rotating member 35 and the rotary member 32 are turned together, causing the damper portion 19 to produce a damping effect due to a viscous resistance of the grease 33 generated from the relative movement between the rotary member 32 and the casing 27. It should be noted that, in the first embodiment, this arrangement enables the damper portion 19 to produce a damping effect when the rotating member 35 is swung in the counterclockwise direction.

The above description can also be applicable to the second embodiment of this invention, in which the damper portion 19 produces a damping effect when the rotating member 35 rotates in the counterclockwise direction.

As explained above, in each of the first and second embodiments, the upper body portion can be opened widely beyond the dead point over the pivotal shaft 17, since the inertia of the upper body portion is absorbed by the spring to reduce the shock applied to the stops. However, it is applicable to the openable apparatus, the upper body portion of which is opened at a position at which the center of gravity passes the dead point by a small degree.

As explained above, this invention provides easy means for opening the upper body portion at an angle of at least 90° so that the exchange of the broken parts or the replacement of the parts to be replaced are easily and safely carried out.

Further, the spring applies a pulling force to the upper body portion when the upper body portion is opened beyond the dead point. Since the pulling force is the strongest at the position at which the upper body portion is fully opened, the shock exerted onto the stop for receiving the opened upper body portion is reduced so that the stop is prevented from being broken from the shock.

Still further, when the upper body portion is moved from the fully opened position to the dead point position, the one-way damper portion is not actuated but only the spring acts to pull the upper body portion in the closing direction. In the course of closing the upper body portion from the dead point position to the fully closed position, the weight of the upper body portion and the attenuating action of the damper portion cooperate to close the portion slowly. In this connection, the upper body portion is closed very softly and smoothly.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A mechanism for opening and closing the openable apparatus, comprising:

a main body having a first body portion, a second body portion and a pivotal axis about which said first body portion is rotated with respect to said second body portion between a closed position, at which said first body portion closes said second body portion, and a fully opened position, at which said first body portion is fully open relative to said second body portion;

a rotary member movable between a first position when said first body portion lies in a predetermined position other than said fully opened position and said closed position and a second position when said first body portion lies in said fully opened position, said rotary member being rotatable about said pivotal axis between said first and second positions in cooperation with the opening and closing movement of said first body portion between said predetermined position and said fully opened position, said rotary member having a gear portion formed in an arcuate shape having a center on said pivotal axis; and said first body portion including a one-way damper mechanism connected directly to said gear portion, and having a rotary gear rotating in cooperation with the opening and closing movement of said first body portion and speed controlling means for controlling a rotational speed of said first body portion when said first body portion is being closed.

2. The mechanism according to claim 1, including means mounting said rotary gear for rotation about a rotary axis in a first rotating direction when said first body portion is moved from said closing position to said predetermined position, and is adapted to be irrotational about said rotary axis when said first body portion is moved from said predetermined position to said fully opened position.

3. The mechanism according to claim 2, wherein said rotary gear is adapted to be irrotational about said rotary axis when said first body portion is moved from said fully opened position to said predetermined position, and is adapted to be rotated in a direction reverse about said rotary axis to said first rotating direction when said first body portion is moved from said predetermined position to the closed position.

4. The mechanism according to claim 1, further comprising biasing means for biasing said rotary member to said first position.

5. The mechanism according to claim 1, wherein said second body portion is a lower body portion and said first body portion is an openable upper body portion disposed over said lower body portion.

6. The mechanism according to claim 1, wherein said predetermined position is a position at which moments of said first body portion in an opening direction thereof and a closing direction thereof are in equilibrium.

7. The mechanism according to claim 1, further including a transmission gear, which is connected between said one-way damper mechanism and said gear portion.

8. A mechanism for opening and closing an openable apparatus, comprising:

a main body having a first body portion, a second body portion and a pivotal axis about which said first body portion is rotated with respect to said second body portion between a closed position, at which said first body portion closes said second body portion, and a fully opened position, at which said first body portion is fully open relative to said second body portion;

a gear portion formed in an arcuate shape having a center on said pivotal axis, and provided in said first body portion;

a rotary member movable between a first position when said first body portion lies in a predetermined position other than said fully opened position and said closed position and a second position when said first body portion lies in said fully opened position, said rotary member being rotatable about said pivotal axis between said first and second positions in cooperation with the opening and closing movement of said first body portion between said predetermined position and said fully opened position; and a one-way damper mechanism provided on said rotary member, and connected directly to said gear portion, and having a rotary gear rotating in cooperation with the opening and closing movement of said first body portion and speed controlling means for controlling a rotational speed of one of said first body portion when said first body portion is being closed.

9. The mechanism according to claim 8, further including a transmission gear, which is connected between said one-way damper mechanism and said gear portion.

10. The mechanism according to claim 8 including means mounting said rotary gear for rotation about a rotary axis in a first rotating direction when said first body portion is moved from said closed position to said predetermined position, and is adapted to be irrotational about said rotary axis when said first body portion is moved from said predetermined position to said fully opened position.

11. The mechanism according to claim 10, wherein said rotary gear is adapted to be irrotational about said rotary axis when said first body portion is moved from said fully opened position to said predetermined position, and is adapted to be rotated in a direction reverse about said rotary axis to said first rotating direction when said first body portion is moved from said predetermined position to the closed position.

* * * * *